US008381825B1

(12) United States Patent
Golinveaux et al.

(10) Patent No.: US 8,381,825 B1
(45) Date of Patent: Feb. 26, 2013

(54) FIRE SPRINKLER SUPPORT STRUT AND METHOD OF USING SAME

(75) Inventors: James E. Golinveaux, N. Kingstown, RI (US); Manuel R. Silva, Jr., Providence, RI (US); Bernhard Abels, Warwick, RI (US); Su Yang, Providence, RI (US)

(73) Assignee: Tyco Fire Products LP, Lansdale, PA (US)

( * ) Notice: Subject to any disclaimer, the term of this patent is extended or adjusted under 35 U.S.C. 154(b) by 427 days.

(21) Appl. No.: 12/611,530

(22) Filed: Nov. 3, 2009

Related U.S. Application Data

(60) Provisional application No. 61/193,186, filed on Nov. 3, 2008, provisional application No. 61/202,990, filed on Apr. 24, 2009.

(51) Int. Cl.
*A62C 37/08* (2006.01)

(52) U.S. Cl. ..... 169/37; 169/40; 169/41; 169/53; 248/75; 248/345

(58) Field of Classification Search ..... 239/282, 239/283, 288.5; 169/37; 248/71, 75, 76, 248/79, 288.5, 220.31, 342, 343, 58, 72, 248/73; 52/220.8; 362/147
See application file for complete search history.

(56) References Cited

U.S. PATENT DOCUMENTS

| | | | | |
|---|---|---|---|---|
| 2,376,167 | A * | 5/1945 | Mitchell | 411/173 |
| 5,080,176 | A * | 1/1992 | Polan et al. | 169/37 |
| 5,083,818 | A * | 1/1992 | Schoot | 285/81 |
| 5,097,906 | A * | 3/1992 | Polan | 169/37 |

FOREIGN PATENT DOCUMENTS

WO WO 2008/067421 6/2008

* cited by examiner

*Primary Examiner* — Len Tran
*Assistant Examiner* — Viet Le
(74) *Attorney, Agent, or Firm* — Perkins Coie LLP

(57) ABSTRACT

A sprinkler mounting strut that secures an unrestrained pipe and a sprinkler together to engage a wall through which the sprinkler extends. The strut provides prongs and engagement portions that secure the strut to the edges of a hole extending through the wall. The strut provides a base against which a pipe abuts to secure the pipe to the wall. The sprinkler extends through an escutcheon and through the base of the strut to engage the pipe and draw the pipe and escutcheon towards each to secure the components to the surfaces of the wall.

12 Claims, 23 Drawing Sheets

FIRE SPRINKLER SUPPORT STRUT AND METHOD OF USING SAME

RELATED APPLICATIONS

This application claims the benefit of priority to U.S. Provisional Patent Application No. 61/193,186, filed on Nov. 3, 2008 and U.S. Provisional Patent Application No. 61/202,990, filed Apr. 24, 2009, each of which is incorporated by reference in its entirety.

FIELD OF THE INVENTION

The subject invention relates to the installation of fire suppression systems and, more particularly, to a strut supporting a sprinkler system and methods of installing sprinkler systems.

BACKGROUND OF THE INVENTION

In some applications of fire protection systems, it is desirable to provide a system that is tamper-proof or difficult to disassemble, such as when a system is installed in a prison, a hospital, or in an institution serving a population that is prone to violence or vandalism. In some applications the piping for the fire protection system is not secured to framing or other rigid structures, or the piping is installed as a retrofit and access to framing and other mounting points is not accessible to secure the piping. In such environments, it is desirable to have a mounting system that secures the pipe relative to the wall through which the sprinkler is disposed, while maintaining an outer surface of the sprinkler that is resistant to vandalism.

A common method for securing an unsecured pipe is to install a tubular spacer over the sprinkler that provides one end that abuts the pipe holding the sprinkler and another end that abuts the wall. However, it is believed that spacers are problematic and not a desirable solution because the spacer is too large to be inserted through the hole of the wall and thus must be installed from the pipe-side of the wall which may not be accessible. Also, it is believed that spacers do not limit the side-to-side movement of the sprinkler and escutcheon, which permits a vandal to slide the sprinkler and escutcheon and gain access to the hole through the wall and damage or disable the fire protection system.

SUMMARY OF THE INVENTION

A fire sprinkler mounting system is described which includes a strut with ends that secure a pipe, the sprinkler, and an escutcheon as a unit to a wall through which the sprinkler extends. The strut includes a base with an opening and prongs extending from the edges of the base. The base engages the pipe or a fitting on the pipe, with or without an additional spacer, to present a mounting point for securing the position of the pipe. The sprinkler extends through the opening in the base of the strut to connect to the pipe or pipe fitting to further secure the position of the pipe in an axial direction of the sprinkler and in a direction orthogonal to the axis of the sprinkler. The prongs preferably include at their ends engagement portions that engage or connect to the edges of the hole through which the sprinkler extends. In a preferred arrangement, the sprinkler extends from the pipe through the opening in the base of the strut and through the hole in the wall, and engages an escutcheon that is held against the wall by the sprinkler. The engagement portions of the strut preferably include undulations shaped to slip over the edges of the wall defining the hole, and the prongs are biased to push radially outward so as to push or bias the undulations against the edges of the wall defining the through hole so as to secure the position of the strut relative to the wall. The prongs can also include ports passing through the prongs to make the prongs more flexible.

Also described is a method of installing a strut to secure a fire sprinkler system. The method includes cutting a hole in the wall, deflecting the strut as the strut is inserted into the wall so that the engagement portions connect to the wall, inserting a pipe or pipe fitting inside the strut so that the threads of the sprinkler engage the pipe or pipe fitting through a hole in the strut, and securing the system by screwing the sprinkler into the pipe to pull the pipe into contact with the strut at one end of the strut and to compress the prongs of the strut against the wall to secure the pipe relative to the wall.

Also described is a method of using a clip to secure a pipe at one end of the clip by pressing the pipe or a pipe fitting against a planar surface of the strut, securing the ends of the prongs to the edges of the hole through the wall, and positioning a sprinkler within the strut between the prongs to further secure the pipe to the wall via the strut.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION

Figure 1:
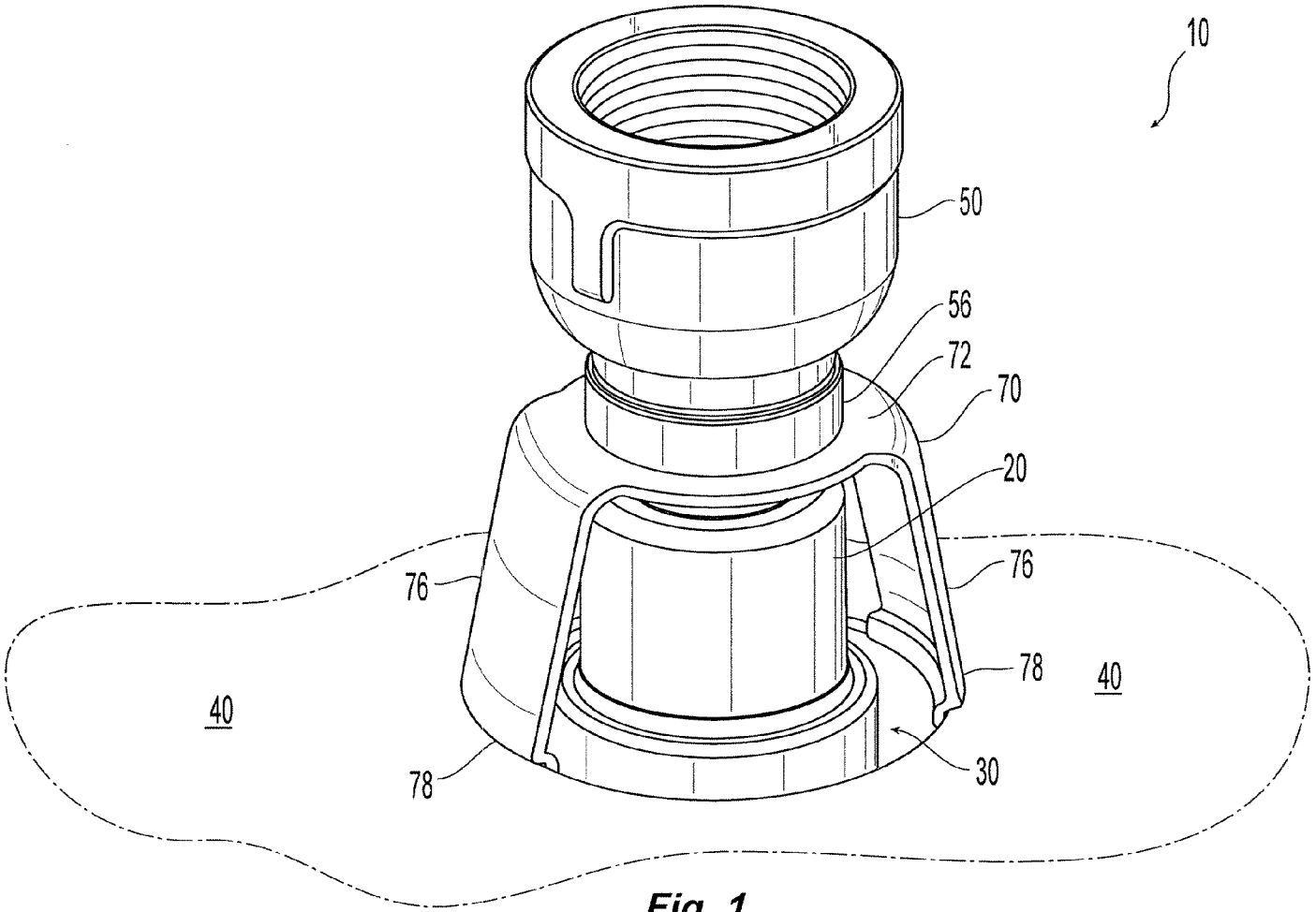
FIG. 1 is an isometric view of a sprinkler system mounted on a ceiling.
Figure 2:
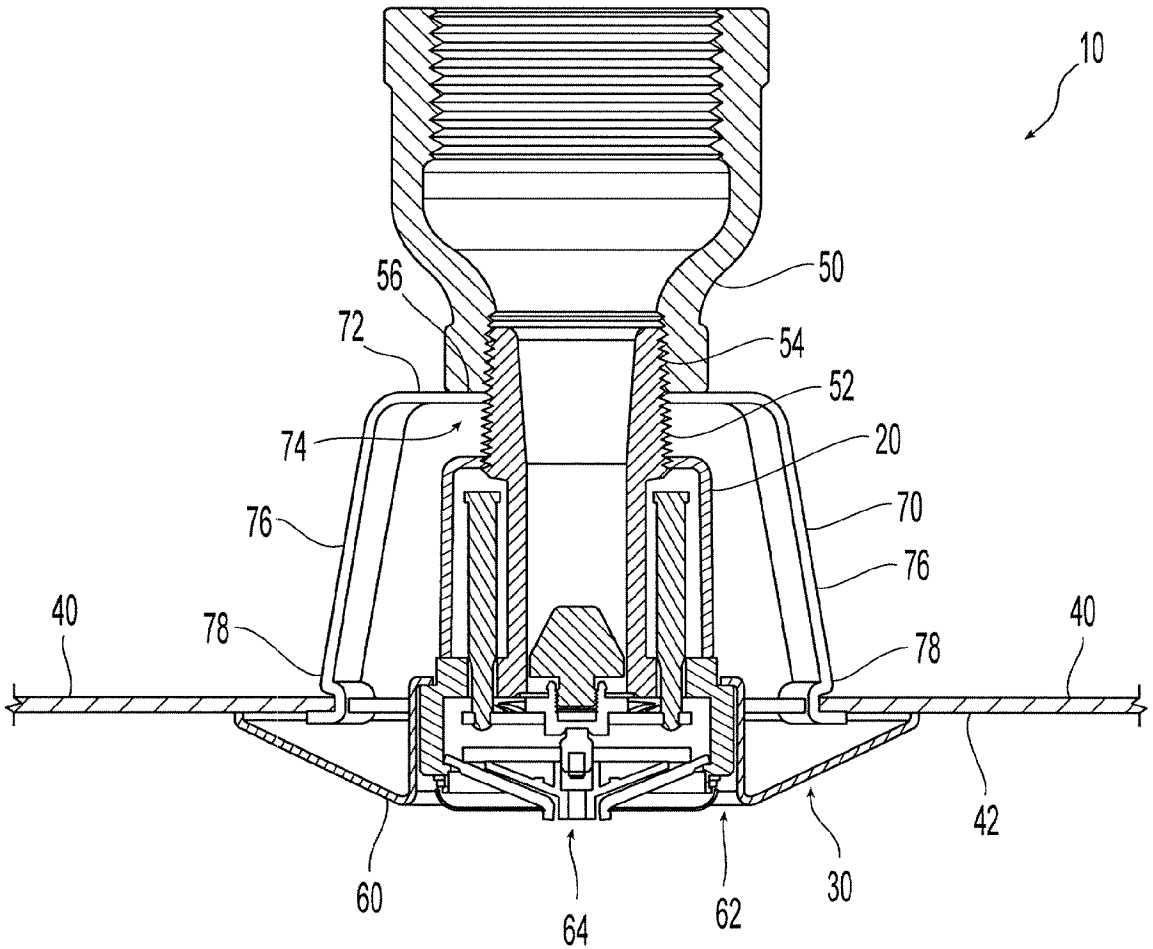
FIG. 2 is a cross-sectional plan view of the sprinkler system of FIG. 1.

As illustrated in FIGS. 1-2, the fire suppression system 10 includes a sprinkler 20 disposed to project through a hole 30 in a wall or ceiling 40. The sprinkler is preferably a concealed sprinkler that has a movable deflector that is disposed near the opening in the wall or ceiling before activation of the sprinkler, and that moves away from the hole when the sprinkler is activated. The preferred sprinkler is illustrated in FIGS. 1-1B of International Publication No. WO 2008/067421, the entirety of which is incorporated by reference. The sprinkler is coupled to a pipe (not shown) that provides water to the sprinkler, with the sprinkler preferably being coupled to the pipe with a reducing coupling 50 that engages the sprinkler with threads 52.

Figure 5:
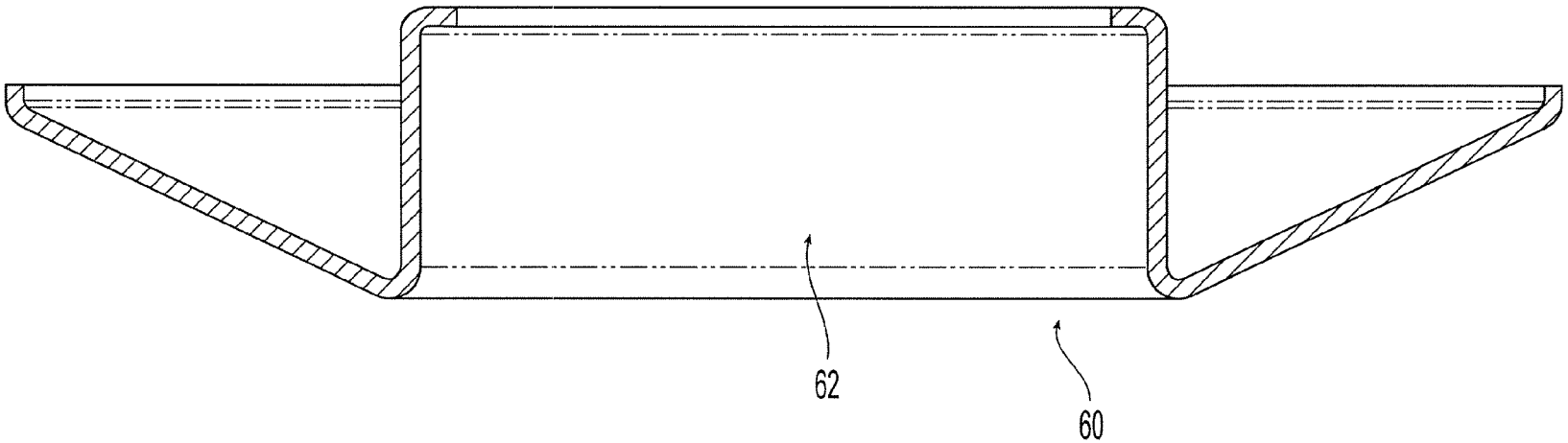
FIG. 5 is a cross-sectional plan view of an escutcheon of FIG. 1.
Figure 6:
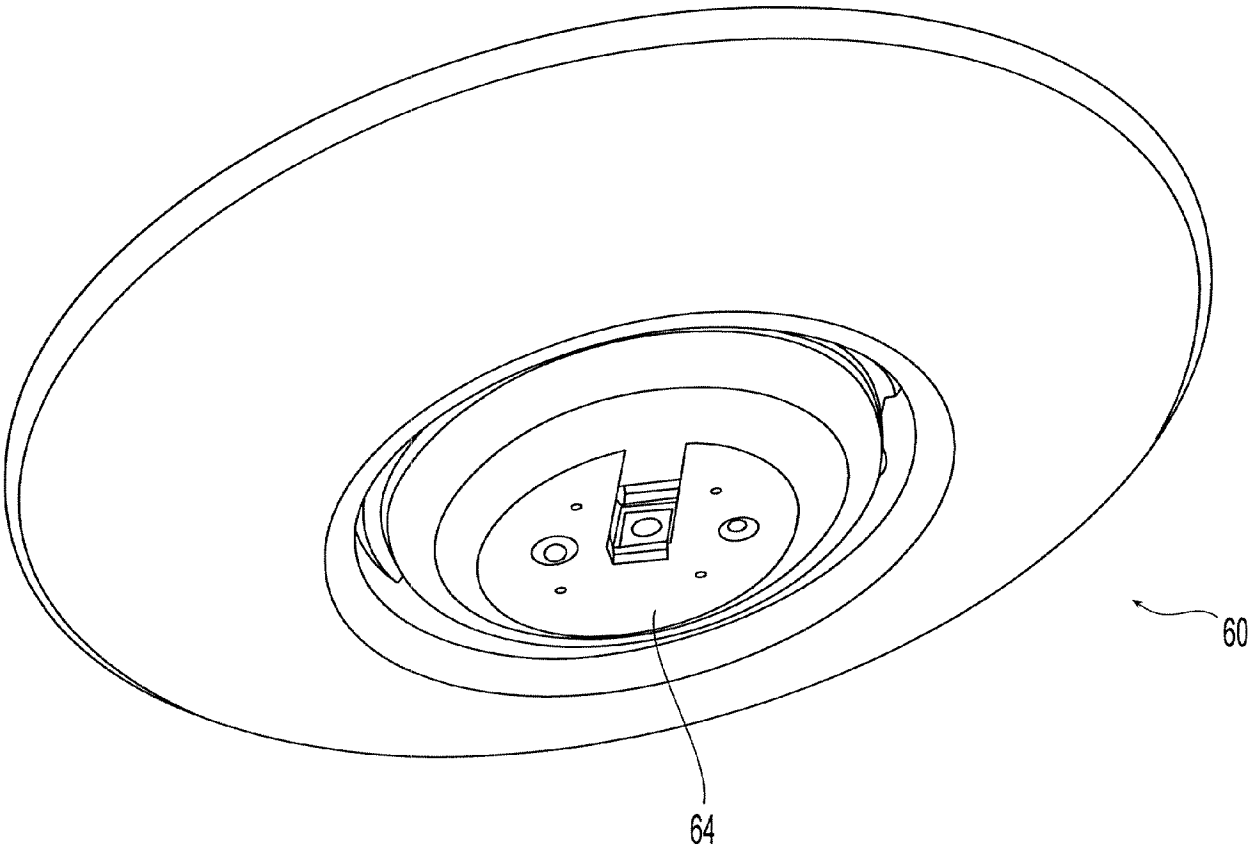
FIG. 6 is an isometric view of a portion of the sprinkler system of FIG. 1.
Figure 7:
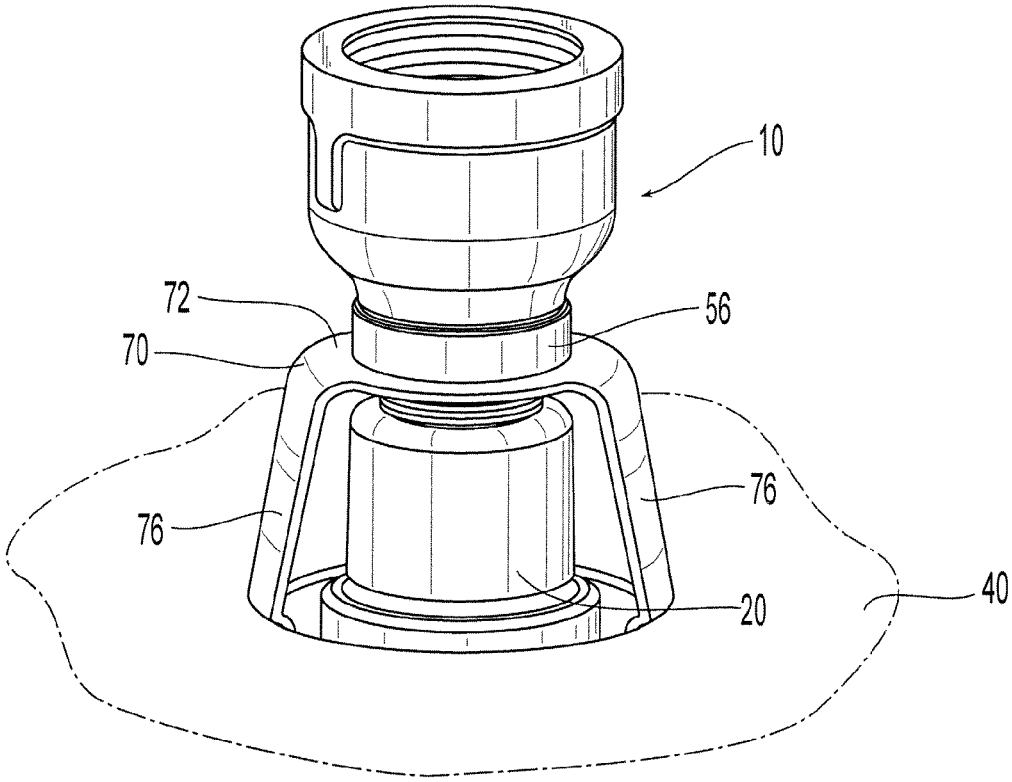
FIG. 7 is an alternative isometric view of the system of FIG. 1.
Figure 8:
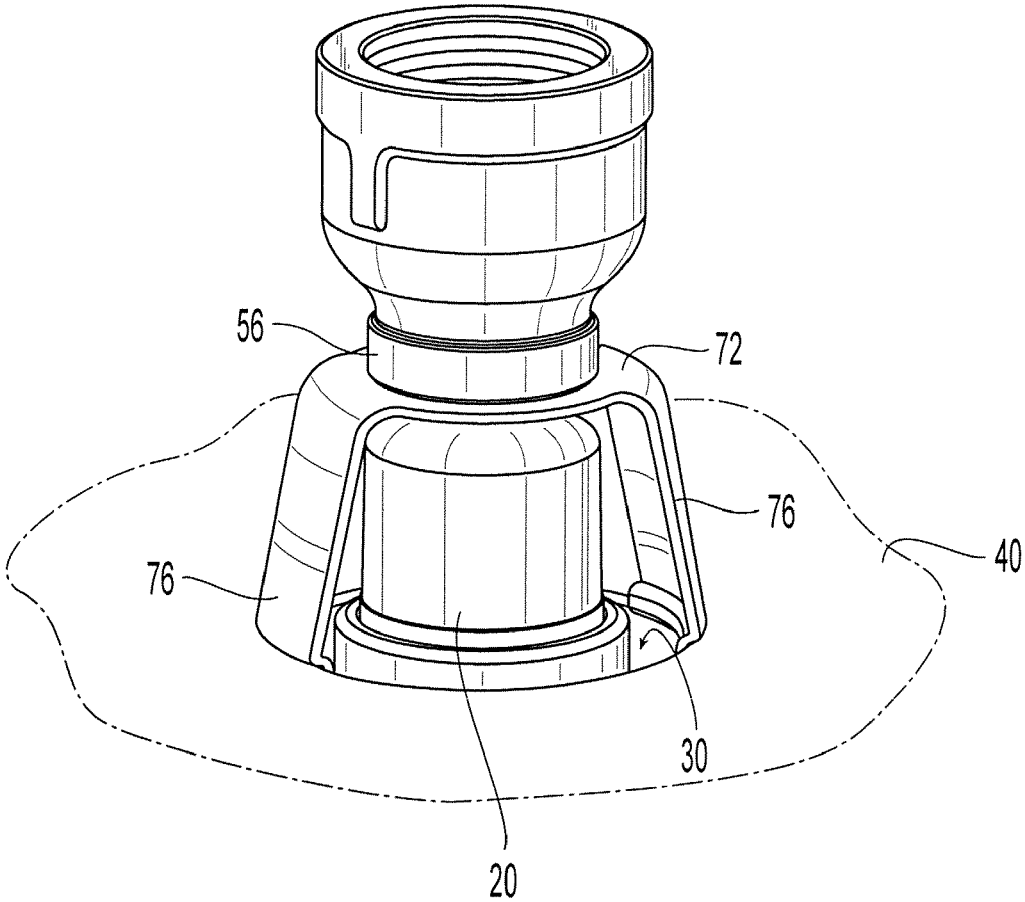
FIG. 8 is an alternative isometric view of the system of FIG. 1.
Figure 9:
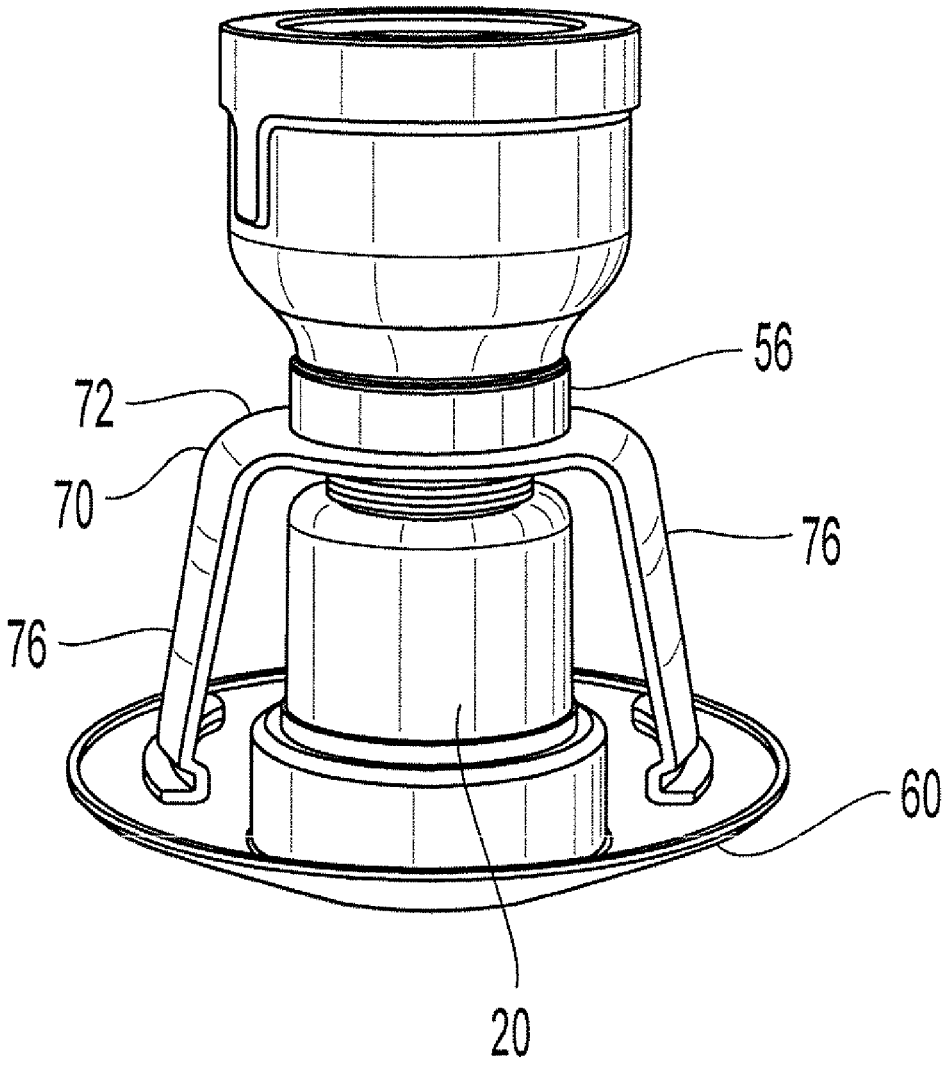
FIG. 9 is an alternative isometric view of the system of FIG. 1 without an image of the wall/ceiling.
Figure 10:
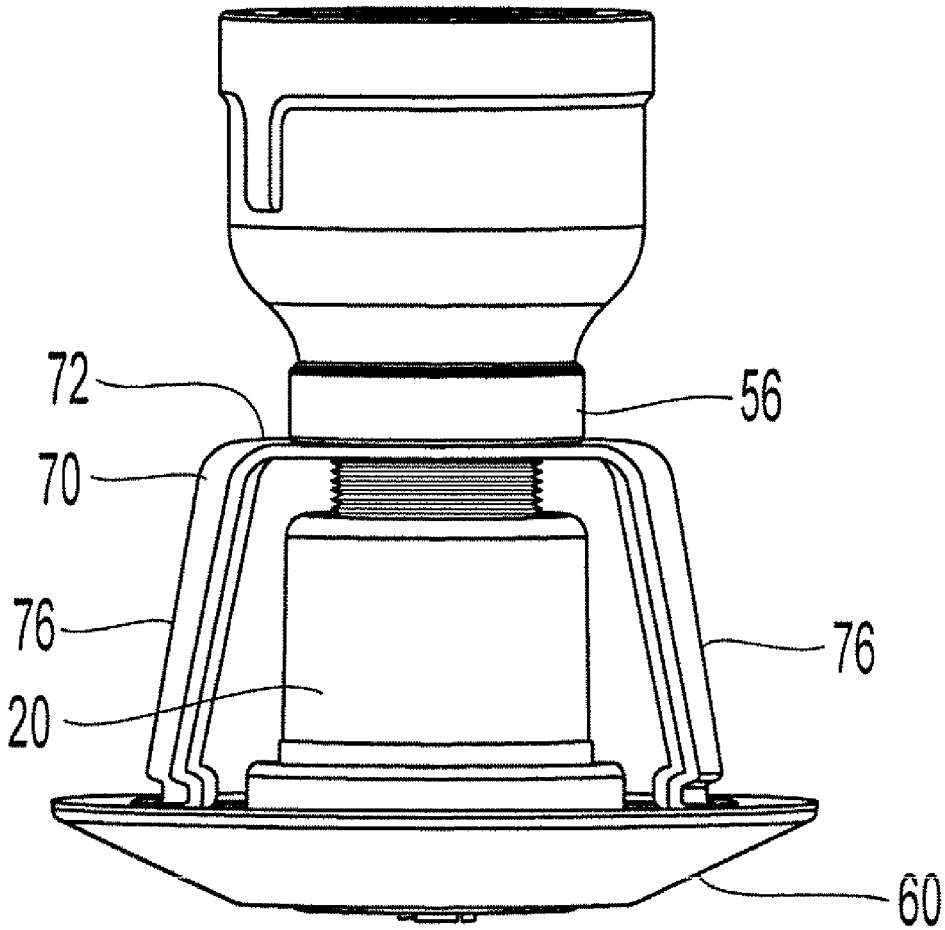
FIG. 10 is a side view of the system of FIG. 1 without shading and without an image of the wall/ceiling.
Figure 11:
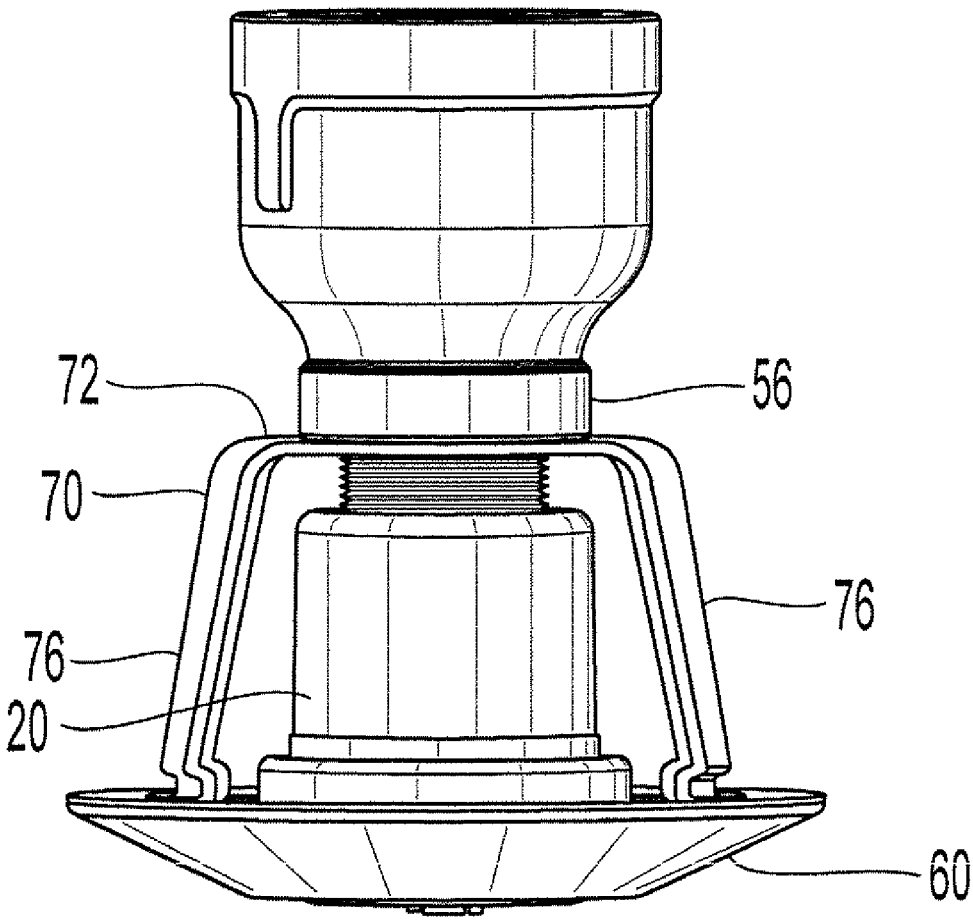
FIG. 11 is a shaded version of the system of FIG. 10.
Figure 12:
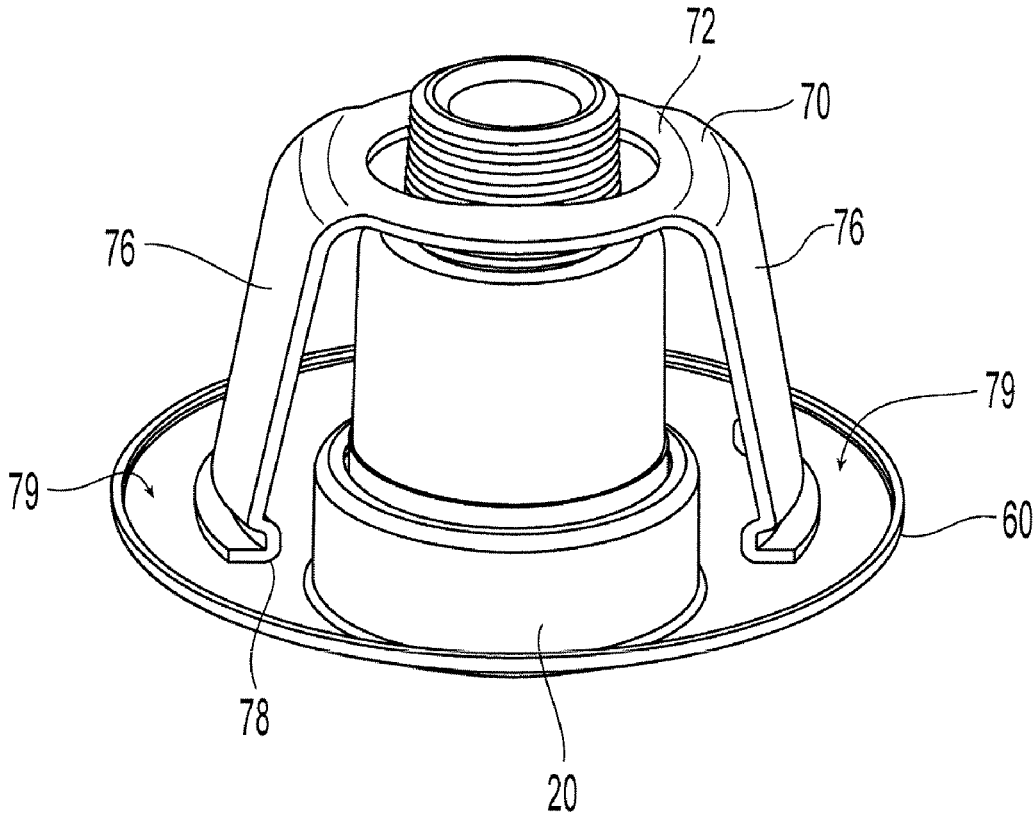
FIG. 12 is an isometric view of the system of FIG. 1 without shading, without the reducing coupling, and without an image of the wall/ceiling.
Figure 13:
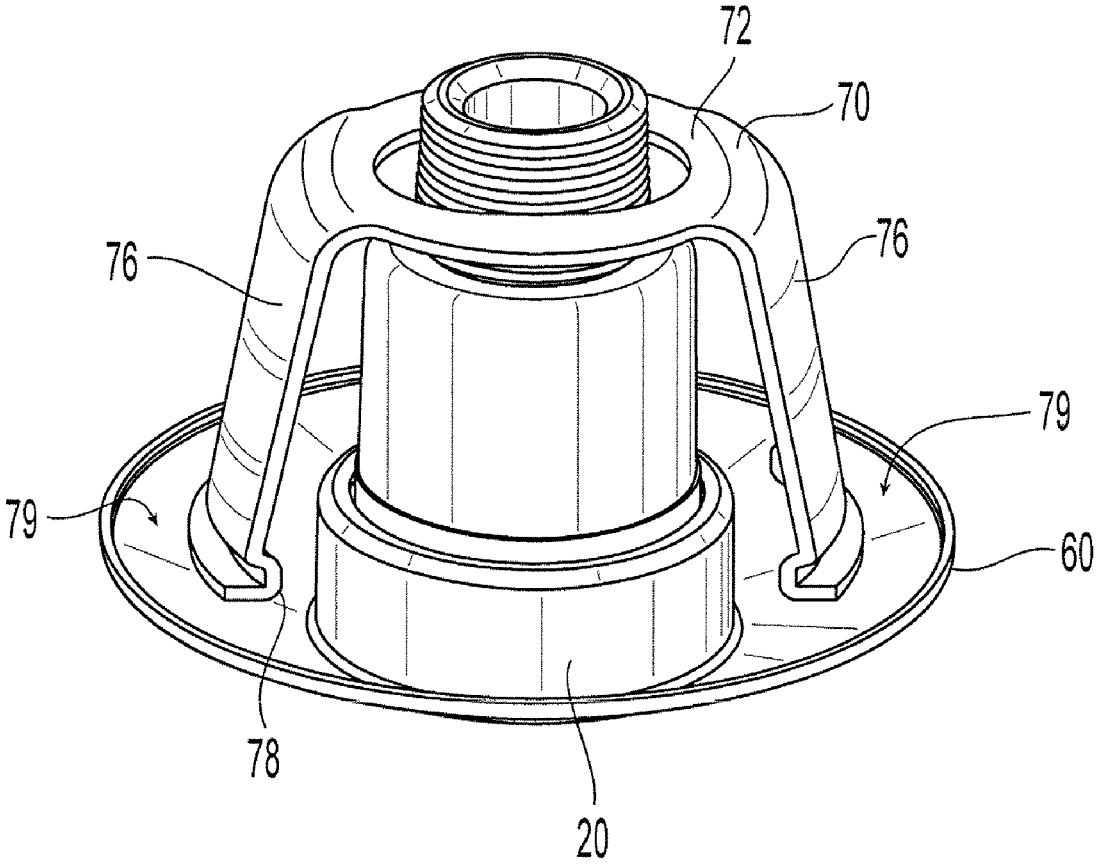
FIG. 13 is a shaded version of the system of FIG. 12.
Figure 14:
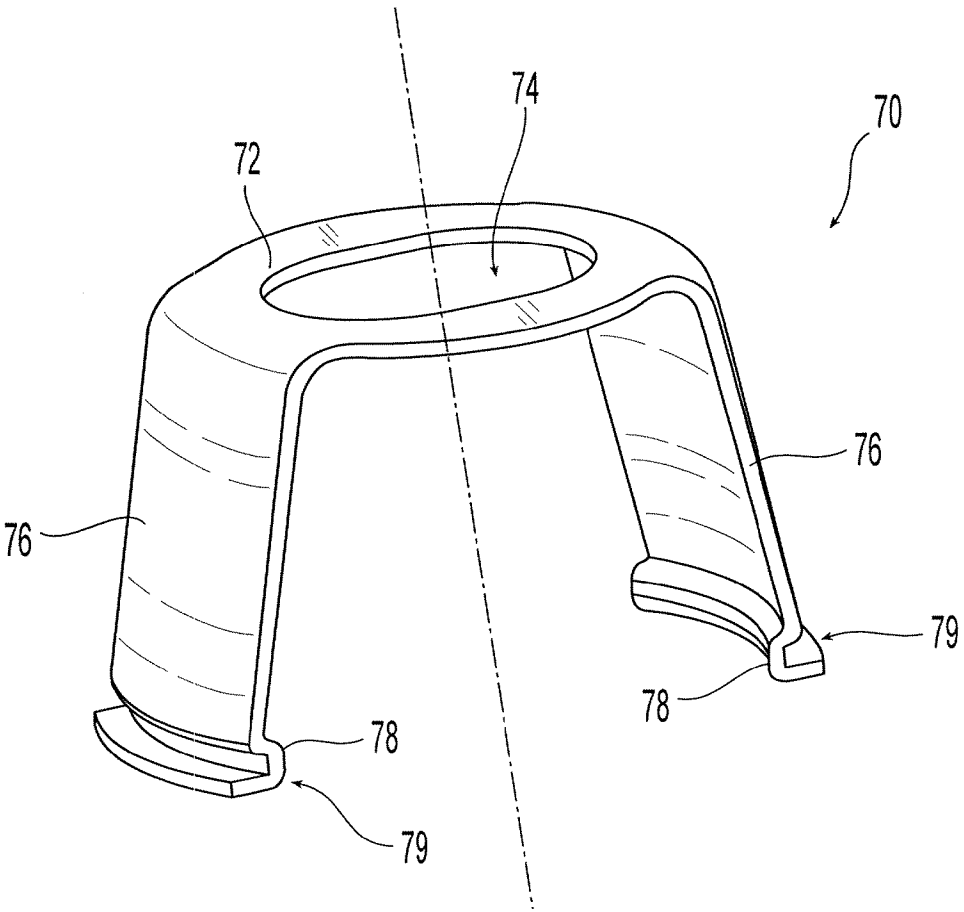
FIG. 14 is a shaded image of FIG. 3.
Figure 15:
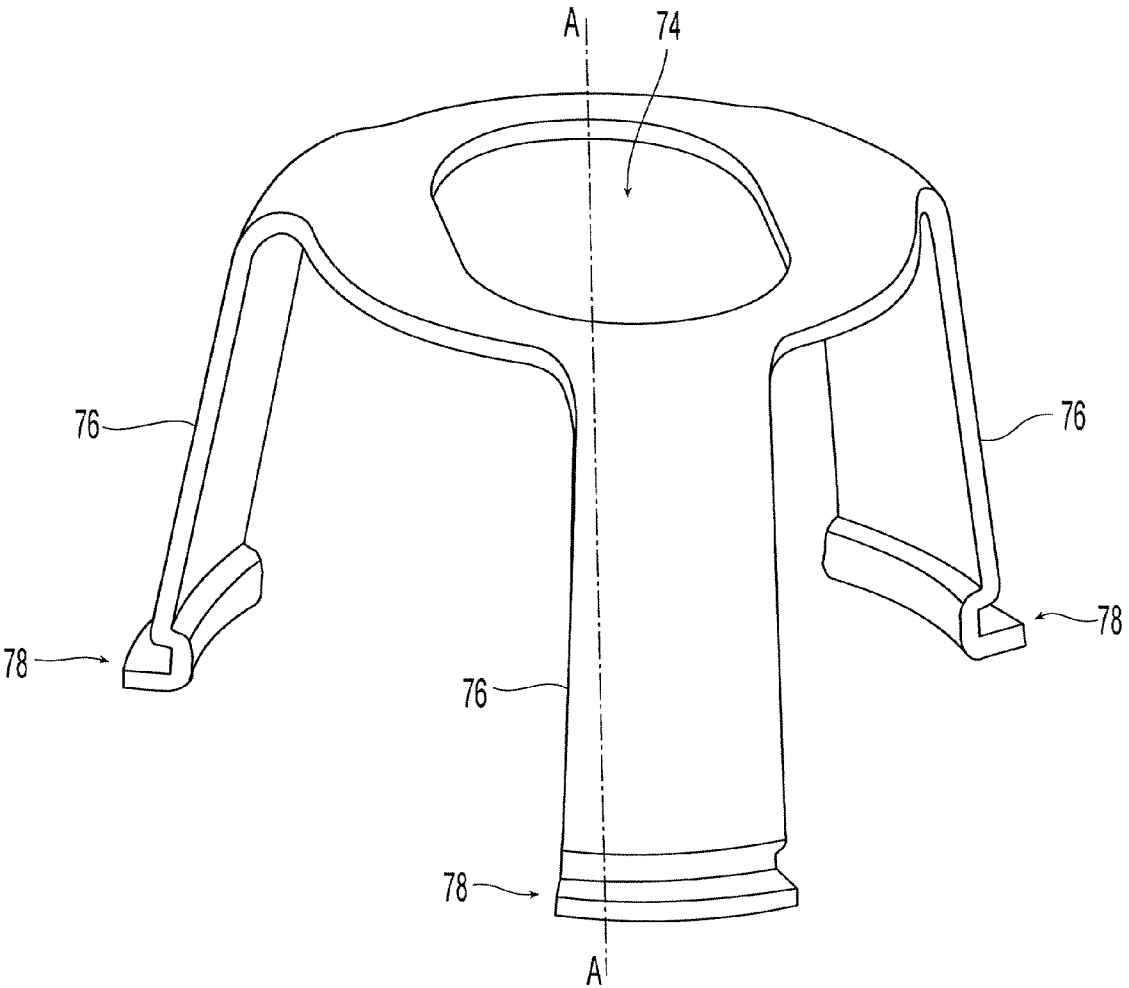
FIG. 15 is a shaded image of FIG. 4.
Figure 16:
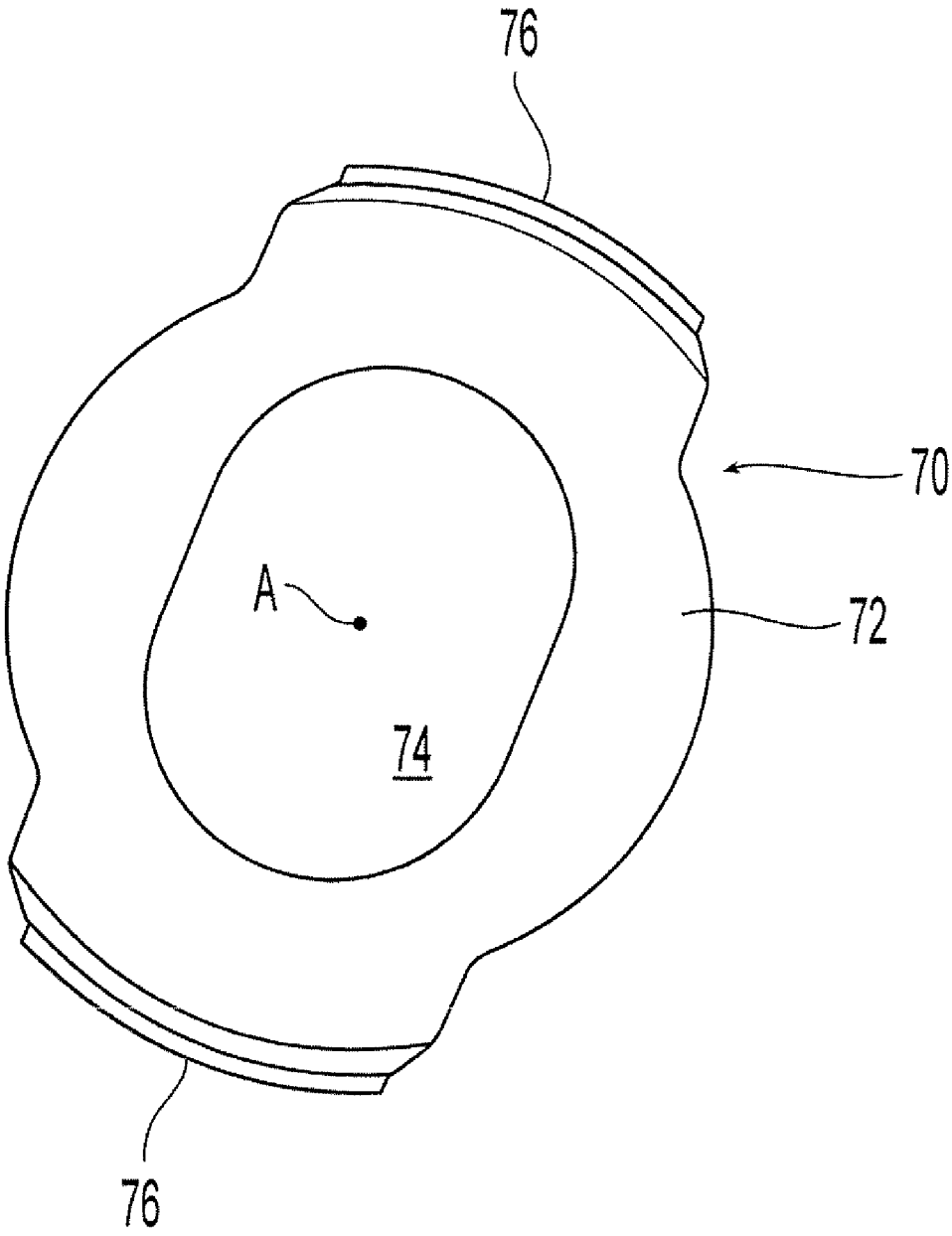
FIG. 16 is a top view of the strut of FIG. 1.
Figure 17:
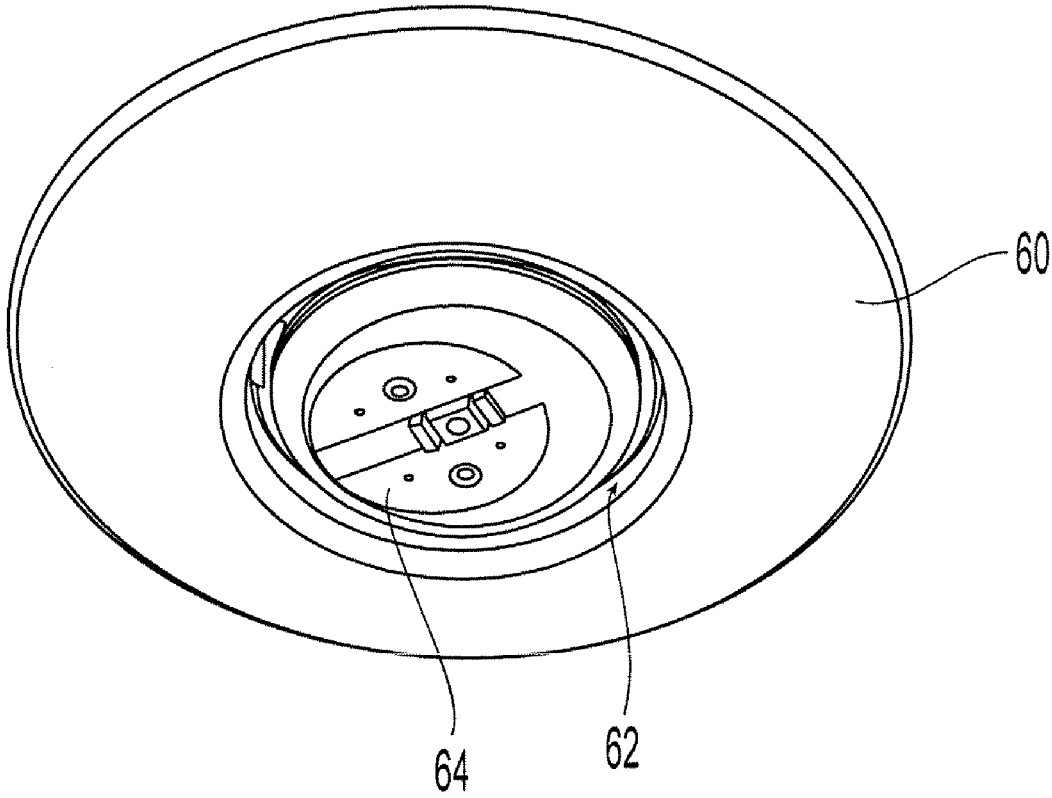
FIG. 17 is an alternative isometric view of the system of FIG. 6.
Figure 18:
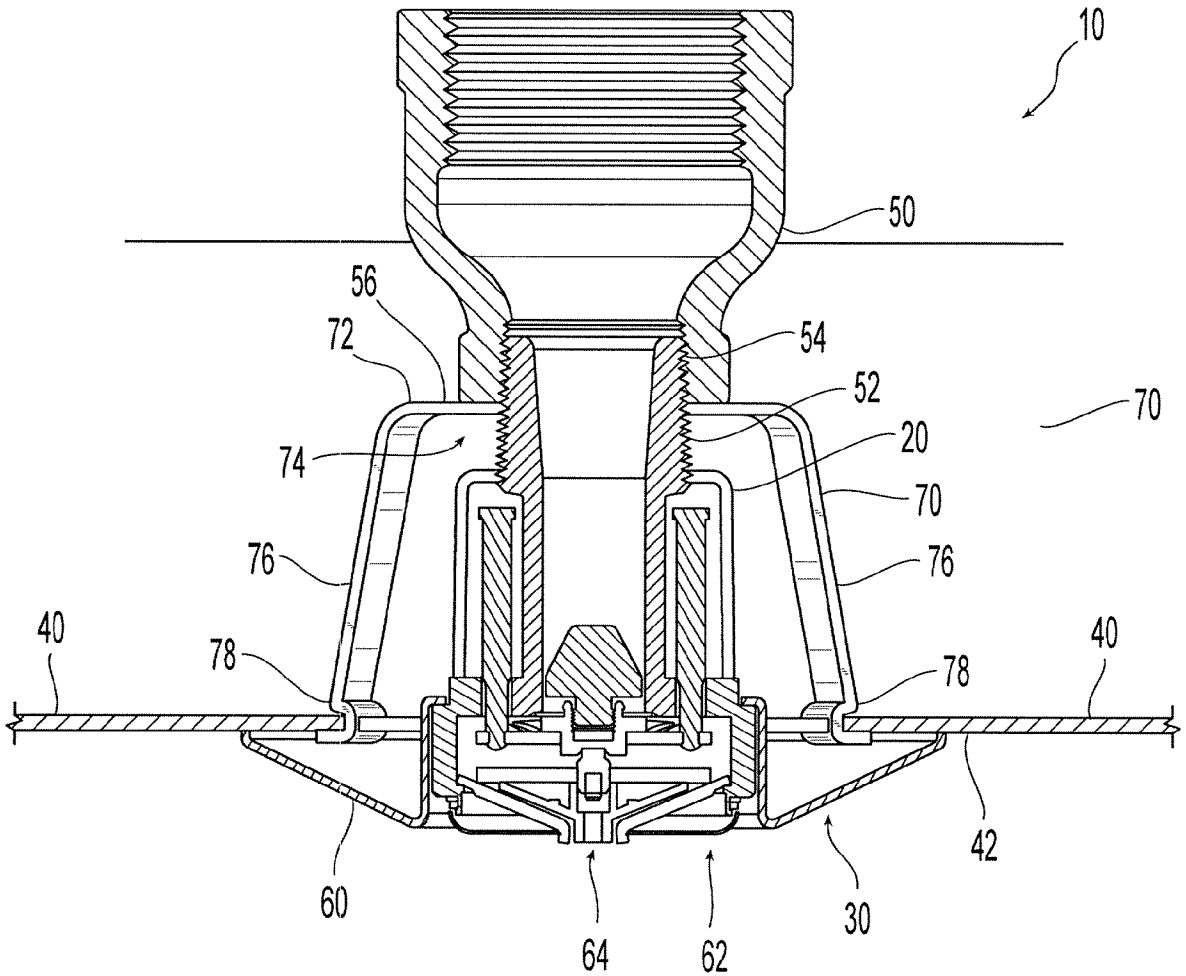
FIG. 18 is a shaded image of FIG. 2.
Figure 19:
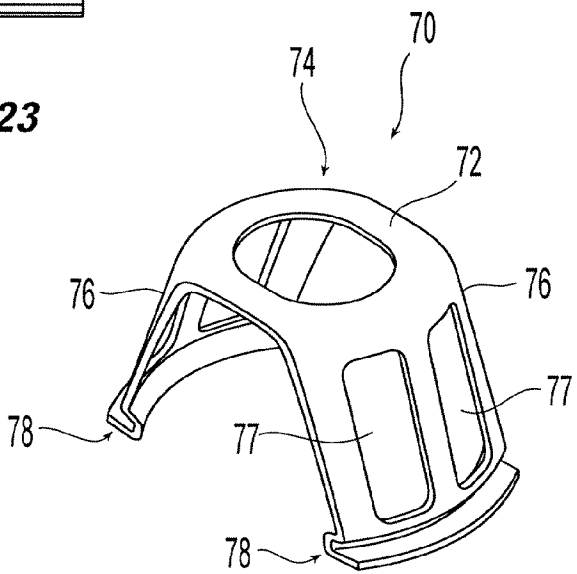
FIG. 19 is an isometric view of an exemplary alternative strut.
Figure 23:
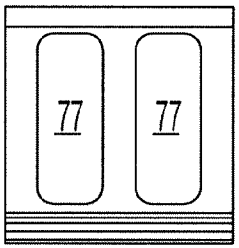
FIG. 23 is a side view of the strut of FIG. 20.
Figure 20:
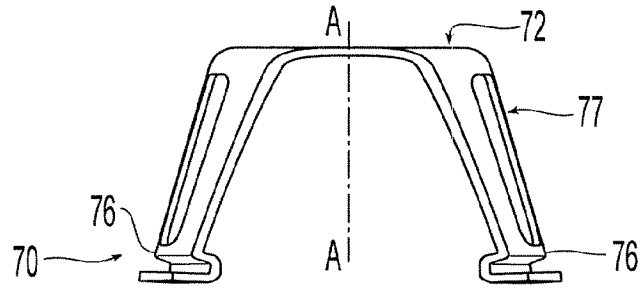
FIG. 20 is a plan view of the strut of FIG. 19.
Figure 21:
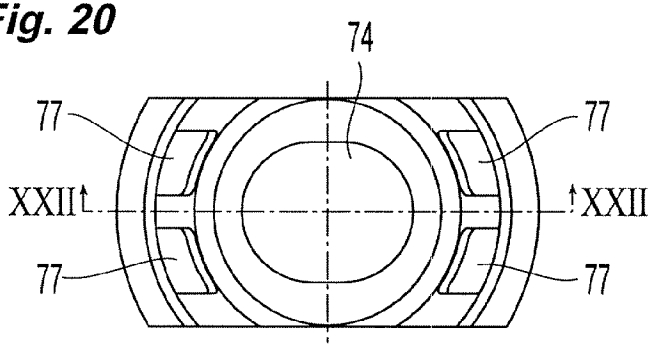
FIG. 21 is a top view of the strut of FIG. 20 with a cross-section line.
Figure 22:
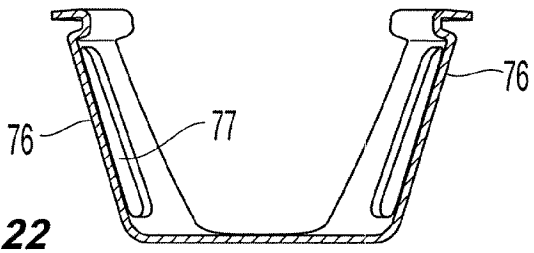
FIG. 22 is cross-section plan view of the strut of FIG. 21 taken along the cross-sectional line of FIG. 20.
Figure 24:
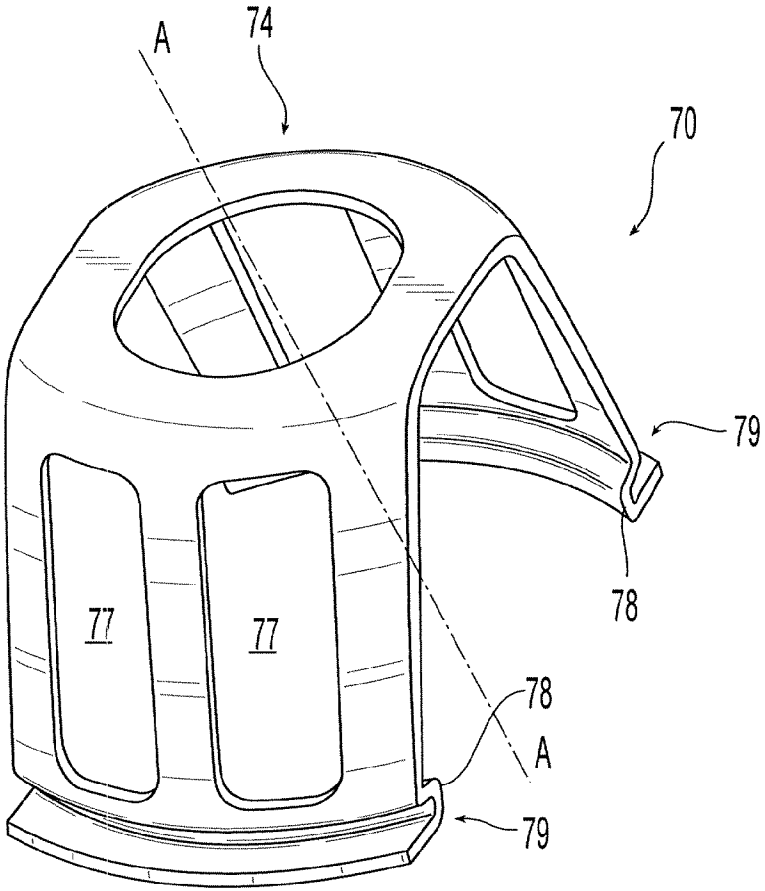
FIGS. 24-27 are additional isometric views of the strut of FIG. 19.
Figure 25:
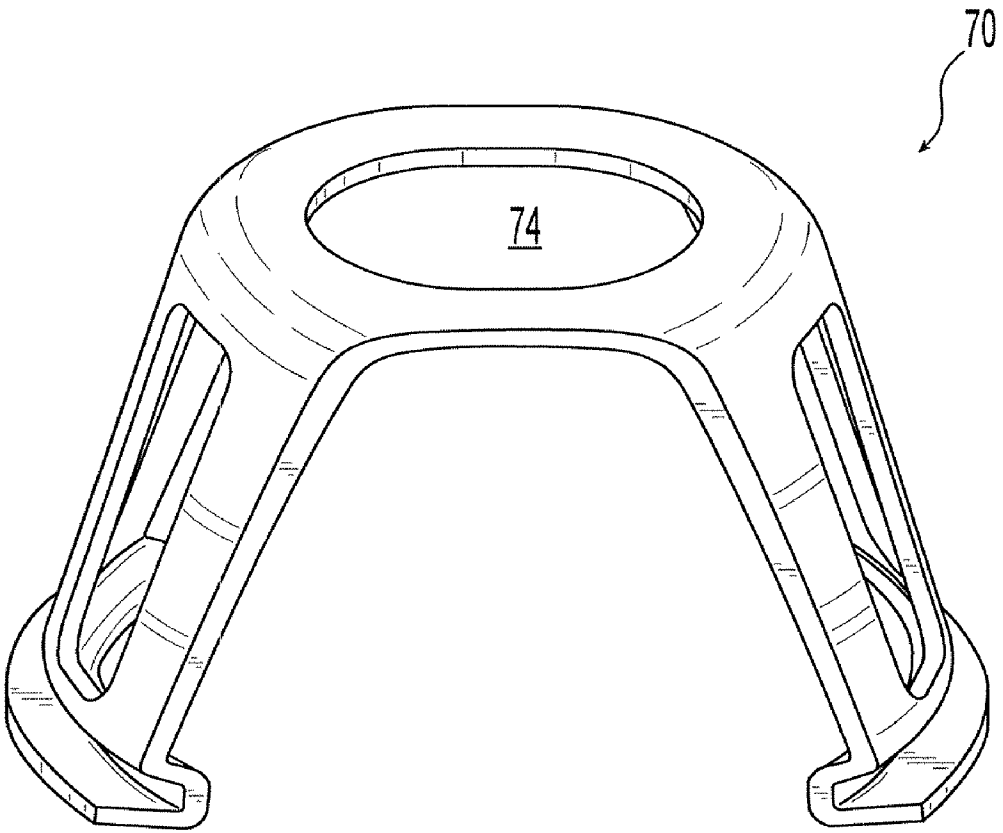
Figure 26:
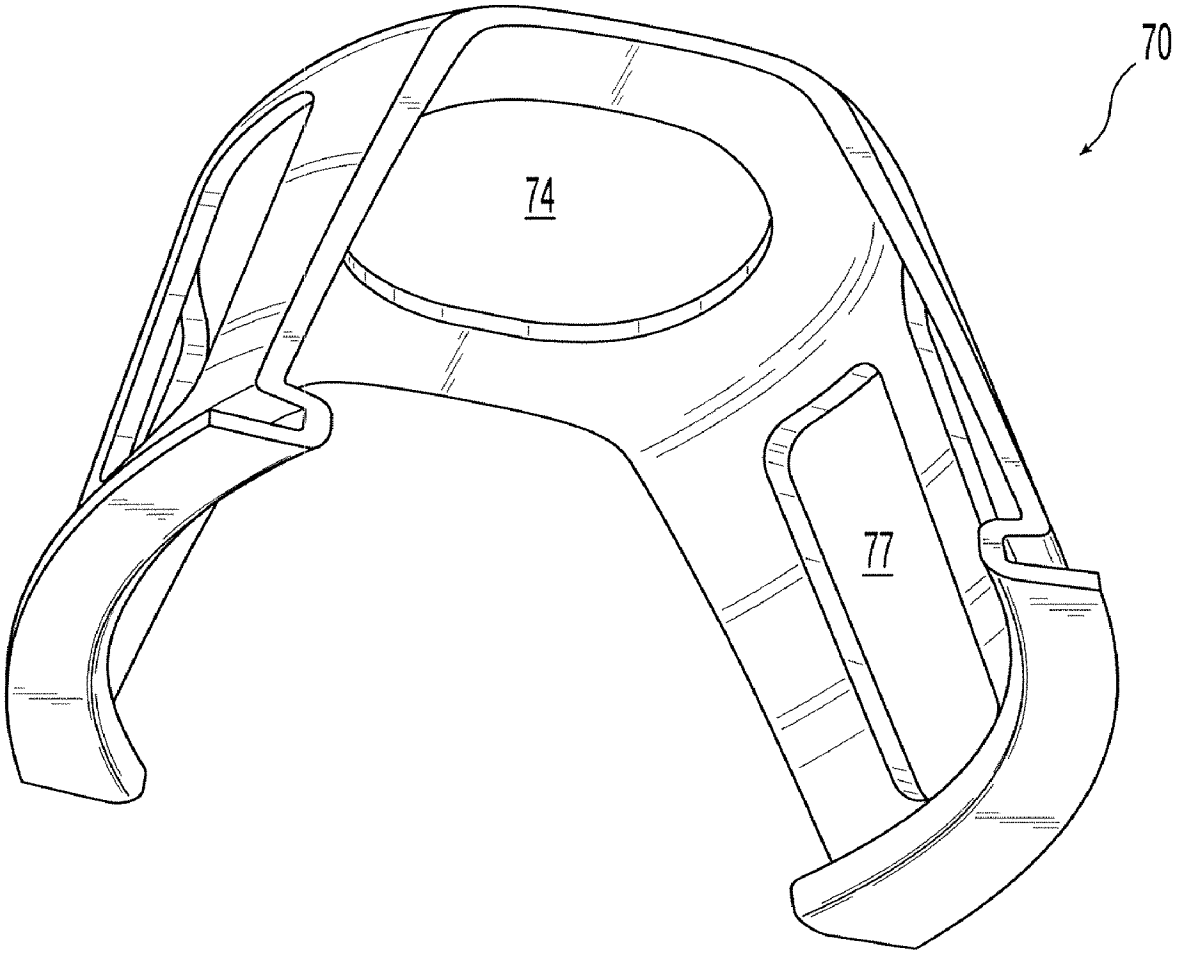
Figure 27:
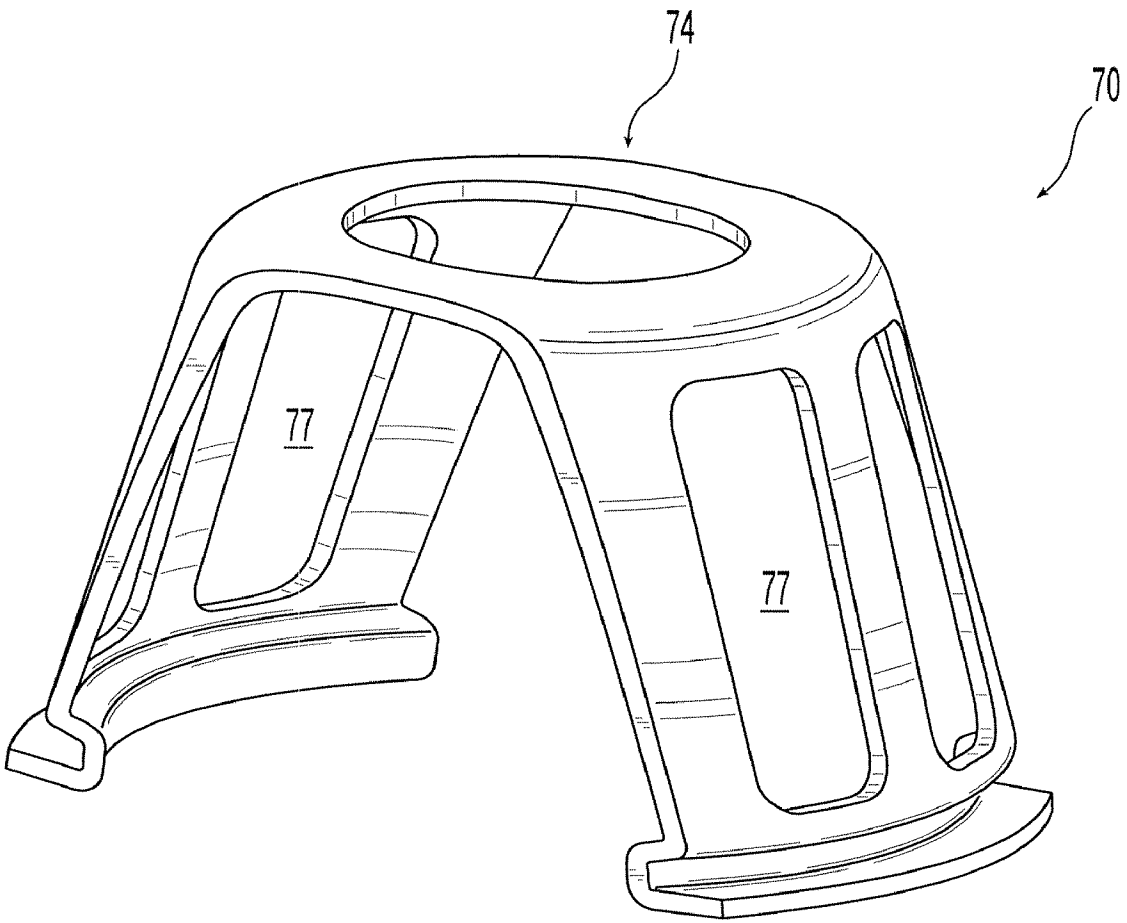

The sprinkler extends through the hole of the wall or ceiling. The wall or ceiling is preferably a thin rigid material such as ¼-inch steel plate, with the hole being a rough-cut circular hole cut in the wall or ceiling in alignment or near alignment with the pipe before the sprinkler is coupled to the pipe. The rough-cut circular hole has edges that are covered by an escutcheon 60 that is placed against the wall on the side opposite to the pipe, with a portion of the escutcheon extending through the hole. As illustrated in FIGS. 1-2 and 5, the escutcheon 60 also provides a cavity 62 that houses a portion of the sprinkler so as to provide a concealed sprinkler system that, from a position facing the deflector, reveals only a terminal end 64 of the sprinkler and the exterior surface of the escutcheon abutting the surface of the wall or ceiling at the outer edges of the escutcheon, as illustrated in FIG. 6. The depth of the cavity 62 into the hole of the wall also disposes the sprinkler in a position that is within the hole of the wall or in a position that is partly on the side of the wall facing the pipe. A flatter profile of the escutcheon, relative to the surface of the wall, is believed to be advantageous because heat moving across the surface of the wall can more easily interact with the elements of the sprinkler.

During assembly, the sprinkler is inserted into the cavity of the escutcheon to form a sprinkler-escutcheon sub-assembly which is then inserted through the hole 30 so that the threads 52 of the sprinkler mate with the threads 54 of the reducing coupling 50 of the pipe and so that the escutcheon is disposed near the surface 42 of the wall or ceiling. The sprinkler-escutcheon sub-assembly is then screwed into the reducing coupling to draw the escutcheon against the wall or ceiling to firmly abut the surface of the wall or ceiling. However, in some installations the pipe is not firmly secured which causes the installed sprinkler-escutcheon sub-assembly to move relative to the wall as the pipe moves within the wall, which causes the escutcheon to undesirably move away from the surface of the wall or ceiling. To address this problem, a strut 70 is provided between the pipe and the escutcheon.

The strut has a base 72 that abuts the end 56 of the reducing coupling. The base preferably includes an outer perimeter and an inner perimeter which defines an opening 74 in the base through which the sprinkler extends through the base and which further preferably defines a central axis A-A of the strut. Preferably, two prongs 76 extend from the outer edges of the base and extend axially towards the edges of the hole in the wall or ceiling. The ends of each prong have an engagement portion 78 that abuts the edges of the hole. The prongs preferably have a bias that disposes the engagement portions at a distance from each other that is greater than a diameter of the hole, so that the prongs must be deflected to make the engagement portions meet the edges of the hole. The deflection creates a spring from the strut that causes the prongs to firmly engage the strut to the wall. The engagement portions are preferably shaped to maintain the position of the strut relative to the wall by wrapping around and over the edge of the hole.

The base is preferably sufficiently wide to provide a surface that abuts the reducing coupling to maintain the coupling and its associated piping at a fixed position relative to the wall. More preferably, the abutting surface of the base is planar and abuts a planar surface of the reducing coupling so as to provide a mostly uniform contact between the base and the reducing coupling that varies due to the oval shape of the opening in the base. Also preferably, the abutting surface of the base extends circumferentially around the reducing coupling to facilitate the even distribution of forces as the sprinkler is screwed into the reducing coupling and the reducing coupling is pressed against the base. However, alternative mating surfaces of the base and reducing coupling provide sufficient contact between components, and provide an appropriate distribution of forces. In an alternative, the base provides a planar surface that is interrupted and that extends for only a portion of the circumference around the reducing coupling. In another alternative the mating surfaces have a non-planar form.

The strut is preferably installed after the hole is created in the wall or ceiling. Once the strut is installed, the sprinkler-escutcheon sub-assembly is inserted into the hole of the wall or ceiling, the threaded end of the sprinkler is inserted through the opening in the base of the strut which positions the sprinkler within the strut, and the threaded end of the sprinkler is screwed into the reducing coupling. The screwing of the sprinkler into the reducing coupling causes the reducing coupling and the escutcheon to move towards each other. The movement of the escutcheon towards the wall/ceiling causes the escutcheon to press against the wall/ceiling, providing a firm engagement with the wall/ceiling. The movement of the reducing coupling towards the hole causes the terminal end of the reducing coupling to abut the base of the strut and press the prongs of the strut against the wall or ceiling, to maintain the reducing coupling at a predetermined distance from the wall/ceiling defined by the lengths of the prongs. The movement thus secures the sprinkler assembly to the wall or ceiling by the abutment of the escutcheon against one side of the wall/ceiling, and the abutment of the prongs against the other side of the wall/ceiling at the edges of the hole.

The strut is preferably formed from a metal, more preferably cut from sheet metal, and most preferably cut from steel sheet metal that is bent to form the strut. The strut preferably is cut to form a circular base with prongs 76 extending outwardly from the base, with the prongs 76 bent to position the ends of the prongs at a predetermined distance from each other that is greater than the diameter of the hole in the wall or ceiling. The base preferably has an opening 74 through the center of the base 72 and, more preferably, the opening is an oval that permits limited side-to-side movement of the sprinkler 20 and reducing coupling 50 during installation. The opening is also preferably sufficiently large to permit the unimpeded insertion of the sprinkler through the opening to facilitate the screwing of the sprinkler into the reducing coupling. The preferred oval shape of the opening facilitates the insertion of the sprinkler through the opening. The base also provides a mounting surface against which the reducing coupling abuts, and the prongs are preferably disposed to maintain the position of the base at a predetermined distance from the wall or ceiling, and at an orientation that presents the mounting surface in a position that permits stable abutment with the reducing coupling.

The prongs 76 are preferably bent where the prongs join the base, and bent about the base 72 to define a distance between the engagement portions 78 of the prongs 76 that is preferably greater than the maximum width or diameter of the hole through the wall or ceiling. The prongs are preferably bent to define a 2.25-inch distance between the engagement portion 78 for a two-inch hole, which requires that each prong be deflected inward to achieve a two-inch distance when inserted into a two-inch diameter hole 30 of the wall or ceiling. The prongs preferably form a spring that, when unrestrained, returns to a size that is greater than the size of the hole in the wall or ceiling. The engagement portion 78 of each prong is preferably formed in the sheet metal with an undulation that is sized to engage and preferably wrap over the edge of the hole of the wall or ceiling. The prongs are also preferably sized to have a first width coming off of the base and a second wider width at the ends of the prongs so as to provide a wide engagement portion that facilitates a stable engagement with the edge of the hole in the wall or ceiling.

The strut is preferably formed to provide one end that engages the hole passing through the wall and another end that engages the fitting on the pipe, so as to define a fixed distance between the pipe and the surface of the wall. Accordingly, the ends of the prongs 76 at the engagement portions 78 are also preferably bent to have a curve about the strut axis A-A that preferably mates with the curve of the edge of the wall/ceiling that defines the hole through which the sprinkler and strut are disposed. The undulations of the engagement portions 78 are preferably formed in the sheet metal with the prongs 76, with bends that turn inwards towards the axis A-A of the strut and then turn outwardly to provide an outwardly accessible channel 79 sized to mate with the edge of the hole in the wall. Also preferably, the channel is curved along its length about the axis A-A to match the perimeter of the hole of the wall. The ends of the prongs 76 are preferably sized to extend through the hole and contact the side of the wall facing the escutcheon. The escutcheon and the ends of the prongs are preferably sized so that the ends of the prongs are disposed within a space defined by the escutcheon.

In the preferred embodiment, the engagement between the strut and the wall involves a clip action at the engagement portion 78, and the engagement between the base 72 of the strut 70 and the reducing coupling is an abutment. However, other engagement arrangements are possible between these components. Also, other points of engagement and other components of the engagement are useable to achieve the desired fixed position of the pipe relative to the wall. In one alternative, instead of the base of the strut engaging the surface of the reducing coupling, the base of the strut is formed to engage the sprinkler directly by engaging the threads 52 of the sprinkler or an outer surface of the sprinkler 20. In this alternative, the sprinkler is secured to the strut and the screwing of the sprinkler into the reducing coupling draws the pipe into a secure connection with the wall via the mounting of the sprinkler to the strut. In another alternative, the base of the strut engages the sides of the reducing coupling or the pipe itself, so as to cause the pipe to assume a secure relationship with the wall. In both of these alternative embodiments, the strut engages the pipe, coupling, or sprinkler by having an inner edge at the opening that provides a mounting surface that compels the pipe towards the wall when the sprinkler is screwed into the coupling. Also, in yet another alternative, the engagement between the strut and the pipe, coupling, or sprinkler is achieved with a glue, a weld, or a screw, or by hooking a projection on one component of the system to a slot on another component arranged to engage and lock in place as the sprinkler is screwed into the coupling. In still another alternative, the strut engages another component, such as a strap or a cable tie, that extends from the strut to engage the pipe or coupling, such as by wrapping around the pipe to join the pipe to the strut and thus secure the pipe to the wall via the strut.

Figure 3:
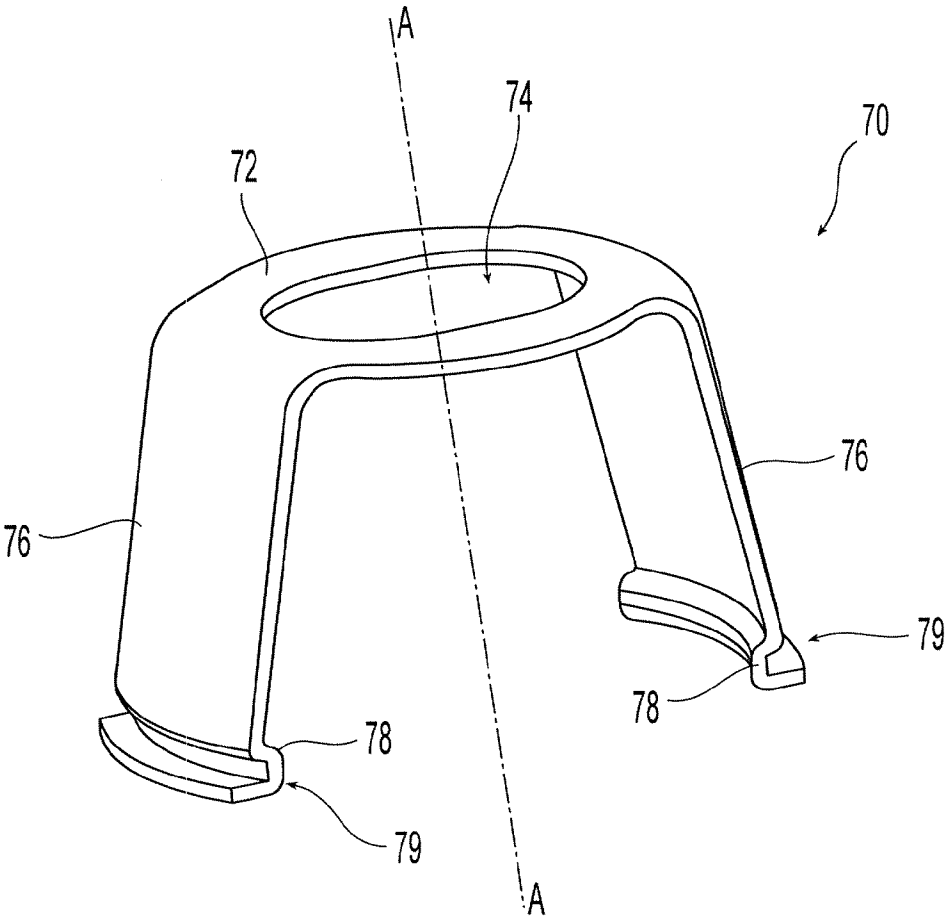
FIG. 3 is an isometric view of a strut.
Figure 4:
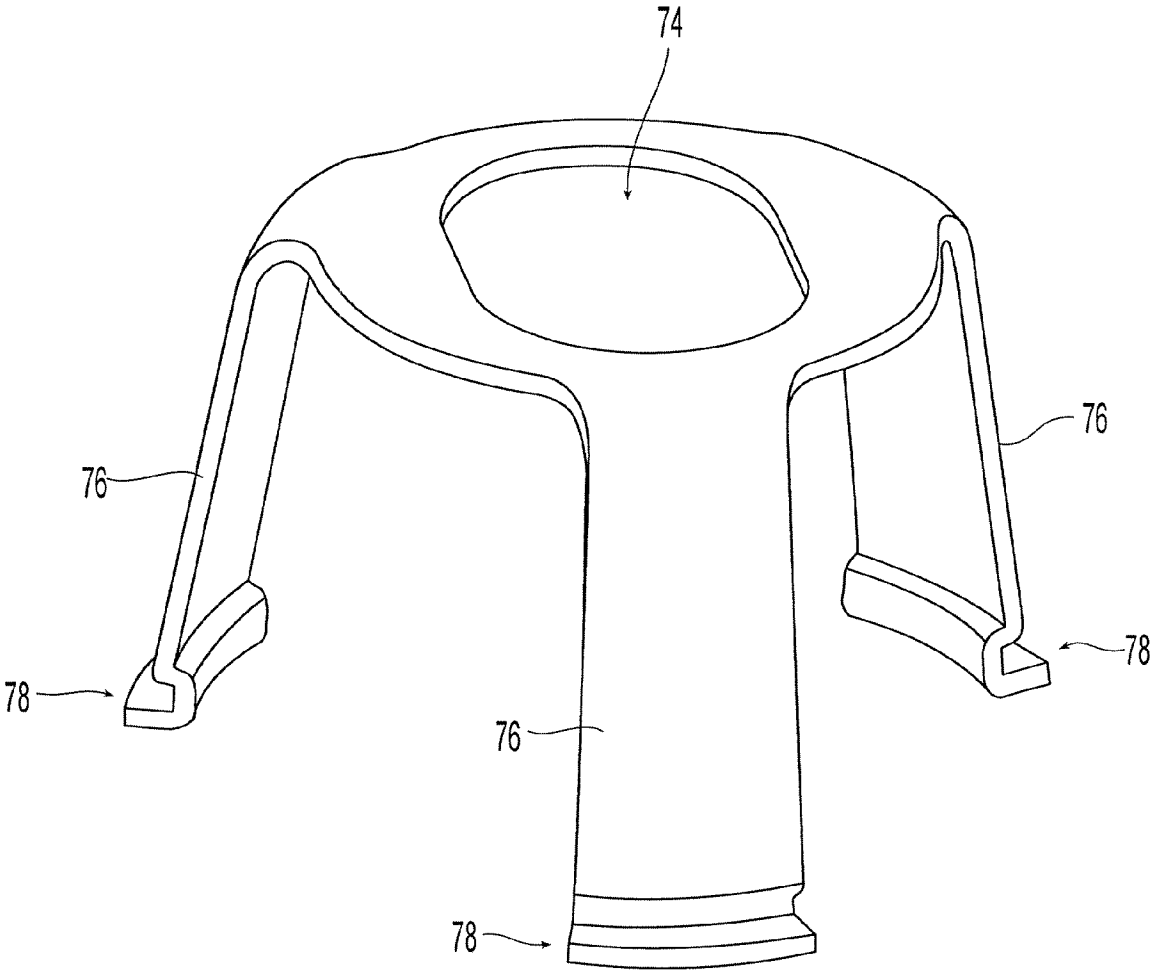
FIG. 4 is an isometric view of an alternative strut.

In the preferred embodiment, the fix position between the base of the strut and the wall is achieved with two prongs extending from the base to the edges of the hole in the wall, as illustrated in FIG. 3. However, other arrangements achieve the same fixed positions between these components. In another alternative, the strut has more than two prongs extending from the base of the strut, such as three illustrated in FIG. 4, or four prongs. In another embodiment, the strut is one large prong that is sufficiently stiff to maintain the position of the base relative to the wall, or the one large prong is wide, for example engaging more than 180 degrees of the wall perimeter defining the through hole, or alternatively, the entire perimeter of the hole through the wall. In another alternative, the engagement portion of the prongs engage the wall with a mechanical element such as a screw, an adhesive, or by engaging a plate disposed on the side of the wall opposite to the pipe. In yet another alternative, the ends of the prongs do not engage the wall but extend through the hole in the wall to engage a side of the wall or a plate disposed on the escutcheon side of the wall opposite to the side of the wall facing the pipe.

It is believed that a preferred wall mounting of a sprinkler-escutcheon sub-assembly provides for an increasingly fixed distance between the pipe and the wall, or a greater fixed distance between the base of the strut and the edge of the hole through the wall. More specifically, in the preferred embodiment, the strut is made with longer prongs to achieve the desired distance between the base of the strut and the wall. In an alternative, the increased distance is achieved by inserting a spacer or washer between the base of the strut and the reducing coupling. In another alternative embodiment, the strut has more than one engagement portion along the length of the prong to facilitate the positioning of the base at different distances from the wall by selecting different engagement portions to clip to the edges of the hole through the wall. In this alternative, the prong provides at least two undulations shaped to wrap around the edges of the hole. At installation, the strut is inserted into the hole so that the edges of the hole are disposed within a first undulation that is the closest undulation relative to the base of the strut, thereby establishing a first distance of the base relative to the wall or ceiling. The prongs of this alternative embodiment continue past the hole and extend from the wall to form a second undulation that is, alternatively, removable from the strut by breakage or cutting if only the first undulation is desired. Alternatively, the escutcheon is formed to accept and cover the portion of the prong having the second undulation and extending past the hole. In this alternative, if the second undulation is desired, the installer further inserts the strut into the wall or ceiling so that the edge of the wall/ceiling is disposed in the second undulation on the strut to dispose the base of the strut at a second distance from the wall/ceiling greater that at the first undulation.

In another alternative, the wall is of a softer or thicker material such as drywall or wood, and the engagement portion of the prongs is formed with a larger undulation to mate with a thicker material. The terminal ends of the prongs at the engagement portions are also preferably wider about the axis A-A to have a greater area of contact with the wall to distribute forces over a greater area on the wall.

In the preferred embodiment, the sprinkler and pipe are maintained in axial alignment with the hole in the wall by the alignment of the base with the hole, by the interaction of the base with the reducing coupling, by the shape and position of the opening in the base, and by the fixation of the engagement portions of the prongs to the wall that maintain the base in a desired position. The base preferably provides sufficient surface area to abut the reducing coupling while providing an opening in the base that preferably fully surrounds the sprinkler as the sprinkler passes through opening in the base to maintain alignment with the hole in the wall. However, alternative arrangements will provide an abutting surface while maintaining the axial alignment of the pipe and sprinkler with the hole in the wall. In an alternative, the base 72 extends partially about axis A-A to define a crescent or c-shaped base and the opening only surrounds part of the sprinkler, which permits the sprinkler to exit the opening through a gap defined by the crescent or c-shape of the base if acceptable for a particular sprinkler system assembly.

An alternative embodiment of the strut is illustrated in FIGS. 19-27, a strut 70 is provided for mounting between the pipe and the escutcheon. The strut 70 has a base 72 that is designed to abut the end 56 of a reducing coupling 50, and an opening 74 in the base is provided to permit a sprinkler to extend through the base. Preferably, two prongs 76 extend from the outer edges of the base and extend away from a plane defined by the base towards the edges of a hole in the wall or ceiling when mounted with the exemplary fire sprinkler mounting system described above. The ends of each prong have an engagement portion 78 that abuts the edges of the hole.

The prongs preferably have a bias that disposes the engagement portions 78 at a predetermined distance from each other that is greater than a diameter of the hole in the wall or ceiling, such that when the strut is disposed within a hole, there is an outward bias that retains the engagement portions in position against the edges of the hole. Accordingly in the preferred embodiment, a radially inward deflection of the prongs 76 toward the axis A-A releases the strut. The deflection causes the strut to act as a spring when the deflecting force applied to one prong is transmitted through the base to one or more prongs extending from the base. The stiffness of the strut provided by the base and prongs is decreased, and flexibility is increased, by providing a series of ports 77 in the prongs 76 that reduce the stiffness of the prongs and permit greater prong deflection. In this alternative strut each prong preferably has two ports 77 as illustrated in FIGS. 19-27, with a rectangular shape with rounded corners and with a strut disposed between two adjacent ports. Also preferably, the ports have a length, extending along a length of the prong that is greater than a width of a port extending circumferentially about a longitudinal axis extending through the strut through the opening 74. Alternatively, only one prong has ports, or the prongs have differing numbers of ports such as one port on one prong and two ports on the other prong. The ports also reduce the amount of material comprising the strut as compared to struts that do not have the ports, which advantageously reduces the weight of the strut.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fire protection system engaging a wall, the wall having a first side and an opposite second side and an edge defining a hole through the wall, the system comprising:

a pipe coupling having an end facing the first side of the wall, the end of the pipe coupling being aligned with the hole in the wall;

a sprinkler engaging the coupling and extending through the hole in the wall; an escutcheon defining an outer surface defining a passage through the escutcheon and extending through the hole in the wall, a portion of the sprinkler disposed within the passage;

a strut having a plurality of prongs extending from a base, the base abutting the coupling, each prong being biased toward the edge of the hole and having an engagement portion abutting the edge of the hole, the base having an outer perimeter and an inner edge defining an opening in the base, the opening further defining a longitudinal axis of the strut, the opening being sized to surround the sprinkler and to allow for lateral movement of the sprinkler with respect to the longitudinal axis within the opening.

2. The system of claim 1, the engagement portion having an undulating surface, the undulating surface disposed to extend over the edge of the hole.

3. The system of claim 1, the base including a spacer disposed to abut the coupling.

4. The system of claim 1, the sprinkler disposed between the plurality of prongs.

5. The system of claim 1, at least one prong having a surface defining at least one port passing through the at least one prong.

6. A strut for a fire protection system, the fire protection system including a sprinkler extending through a hole in a wall, the strut comprising:

a base having an outer perimeter and an inner edge defining a opening in the base, the opening further defining a longitudinal axis of the strut, the opening being sized to surround the sprinkler and to allow for lateral movement of the sprinkler with respect to the longitudinal axis within the opening; and a plurality of prongs extending from the outer perimeter of the base, each prong extending away from the base in a direction of the longitudinal axis, each prong including an end portion disposed at a radial distance from the axis that is greater than a radial distance defined by the outer perimeter of the base, the end portion of each prong having an undulation extending towards the axis, the undulation defining a channel for engaging the hole in the wall as the plurality of prongs are biased away from the longitudinal axis.

7. The strut of claim 6, the prongs disposed to deflect inwardly towards to the axis.

8. The strut of claim 6, wherein the plurality of prongs comprises two prongs and the opening in the base comprises an oval perimeter.

9. The strut of claim 6, the channel extending about a circumference around the axis.

10. The strut of claim 6, at least one prong having a surface defining at least one port passing through the at least one prong.

11. A method for installing a fire sprinkler system, comprising:

forming a hole in a wall, the hole defined by edges of the wall;

inserting a strut through the hole to deform prongs of the strut to dispose and bias engagement portions of the prongs over the edges of the wall and to position a base of the strut at a predetermined distance from the wall;

inserting said fire sprinkler into an opening in the base of the strut, the opening allowing for lateral movement of the fire sprinkler in the opening, and engage a pipe abutting the base of the strut;

and securing the pipe to the wall by communication with the strut.

12. The method of claim 11, at least one prong having a surface defining at least one port passing through the at least one prong.

* * * * *